US007445466B1

(12) United States Patent
Peng

(10) Patent No.: US 7,445,466 B1
(45) Date of Patent: Nov. 4, 2008

(54) BOARD-TO-BOARD CONNECTOR ASSEMBLY

(75) Inventor: Yung-Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/878,958

(22) Filed: Jul. 30, 2007

(51) Int. Cl.
*H01R 12/00* (2006.01)

(52) U.S. Cl. ..... 439/74; 439/570

(58) Field of Classification Search ..... 439/71, 439/74, 108, 570, 660, 698
See application file for complete search history.

(56) References Cited

U.S. PATENT DOCUMENTS 3,910,664 A * 10/1975 Pauza et al. ..... 439/71
5,360,353 A * 11/1994 Kinoshita ..... 439/620.09
6,132,258 A * 10/2000 Kajinuma ..... 439/660
6,986,670 B2 * 1/2006 Okura et al. ..... 439/74
7,134,882 B2 * 11/2006 Iida et al. ..... 439/74
7,223,125 B2 * 5/2007 Chen ..... 439/609

* cited by examiner

*Primary Examiner*—Thanh-Tam T Le
(74) *Attorney, Agent, or Firm*—Rosenberg, Klein & Lee

(57) ABSTRACT

A board-to-board connector assembly includes a receptacle and a plug. The receptacle has a receptacle housing, first contacts and two first fixing contacts mounted in the receptacle housing. The receptacle housing has a base, two first sidewalls, and two second sidewalls. A recess is formed among the base and the sidewalls. Each first fixing contact has a first fixing portion fixed in the corresponding second sidewall, the middle of the first fixing portion extending upward then bending downward to form an elastic portion which extends to form a contacting portion. The plug has a plug housing received in the recess, second contacts mounted in the plug housing, and two second fixing contacts. Each second fixing contact has a second fixing portion fixed in two opposite ends of the plug housing, the contacting portion of the first fixing contact being against the outside of the second fixing portion.

4 Claims, 4 Drawing Sheets

BOARD-TO-BOARD CONNECTOR ASSEMBLY

BACKGROUND OF THE INVENTION

1. Field of the Invention

The present invention generally relates to a board-to-board connector assembly, and more particularly to a connector assembly having a receptacle and a plug capable of assuring a firm engagement therebetween.

2. The Related Art

In the field of the electronics industry, in order to electrically connect two parallel printed circuit boards (PCBs), it is necessary to provide a surface mount miniature board-to-board connector assembly which is composed of a receptacle with a plurality of first contacts and a plug with a plurality of second contacts. One end of the first and second contacts engages with each other, the other end of the first and second contacts connects to the corresponding printed circuit board respectively.

At present, the trend of the electronic industry is to constantly reduce the sizes of electronic devices. The board-to-board connector assembly used in the miniaturization consumer electronic devices is correspondingly required a tinier size. Moreover, the contacts of the connectors are arranged thicker as possible. In this consequence, it becomes difficult to ensure a firm engagement between the plug and the receptacle of the board-to-board connector assembly. The conventional board-to-board connector assembly realizes a firm engagement between the plug and the receptacle by the cooperation of changing structures of the contacts and disposing locking portions in the receptacle and the plug.

However, the contacts of the conventional board-to-board connector assembly are easy to be yielded or distorted, then the plug and the receptacle can not be firmly engaged with each other, therefore, the electrical connection between the plug and the receptacle is not reliable.

SUMMARY OF THE INVENTION

An object of the present invention is to provide a board-to-board connector assembly which has a receptacle and a plug engaged with each other firmly.

The board-to-board connector assembly in accordance with the present invention comprises a receptacle and a plug. The receptacle has a receptacle housing, a plurality of arrayed first contacts and two first fixing contacts mounted in the receptacle housing. The receptacle housing has a base, two first sidewalls protruding upward from two opposite sides of the base, and two second sidewalls protruding upward from two opposite ends of the base. A recess is formed among the base and the sidewalls. Each first fixing contact has a first fixing portion fixed in the corresponding second sidewall, the middle of the first fixing portion extends upward then bends downward to form an elastic portion, the elastic portion extends to form a contacting portion extending into the recess of the receptacle housing. The plug has a plug housing received in the recess of the receptacle housing, a plurality of arrayed second contacts mounted in the plug housing for electrically connecting the corresponding first contacts of the receptacle and two second fixing contacts. Each second fixing contact has a second fixing portion fixed in two opposite ends of the plug housing, the contacting portion of the first fixing contact is against the outside of the second fixing portion.

As described above, the contacting portion of the first fixing contact of the receptacle is against the second fixing portion of the second fixing contact of the plug, therefore, the receptacle and the plug can be firmly engaged with each other, furthermore, a reliable electrical connection between the plug and the receptacle is realized.

BRIEF DESCRIPTION OF THE DRAWING

The present invention will be apparent to those skilled in the art by reading the following description of an embodiment thereof, with reference to the attached drawing, in which.

DETAILED DESCRIPTION OF THE PREFERRED EMBODIMENT

Figure 1:
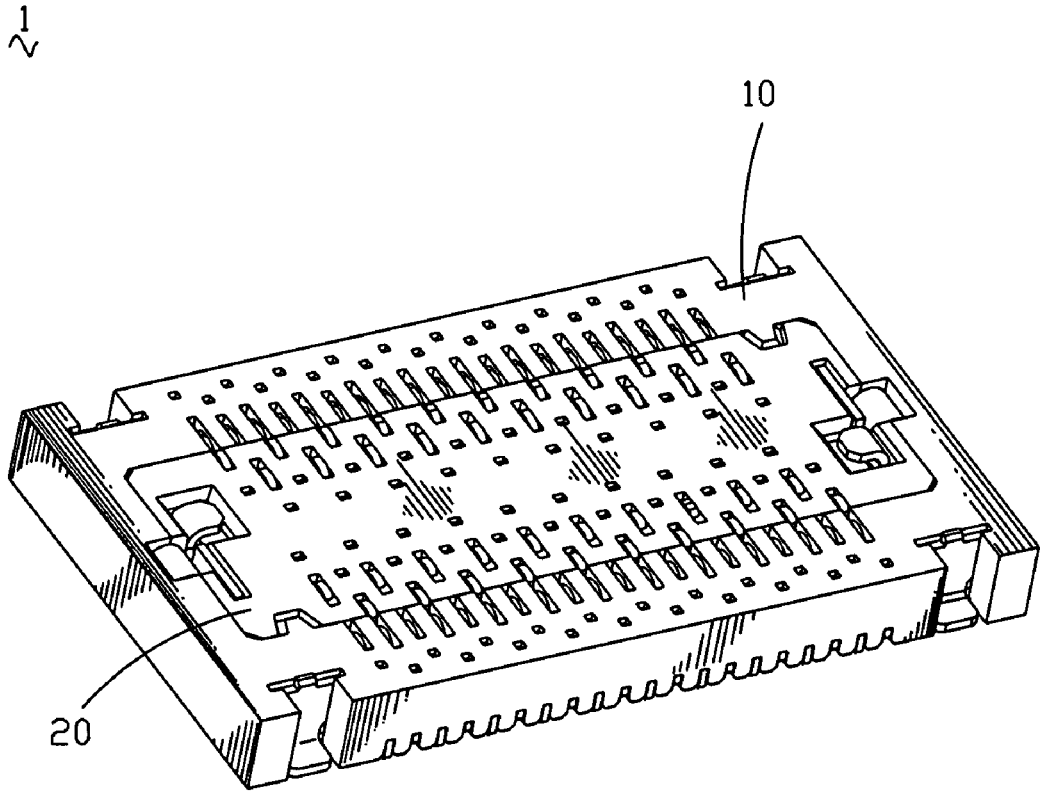
FIG. 1 is a perspective view of a board-to-board connector assembly in accordance with the present invention.

Referring now to FIG. 1, a board-to-board connector assembly 1 in accordance with the present invention is shown. The connector assembly 1 is composed of a receptacle 10 and a plug 20 which are respectively of flat configurations for surface mounting on individual printed circuit boards (PCBs) (not shown) to interconnect circuits on the boards.

Figure 2:
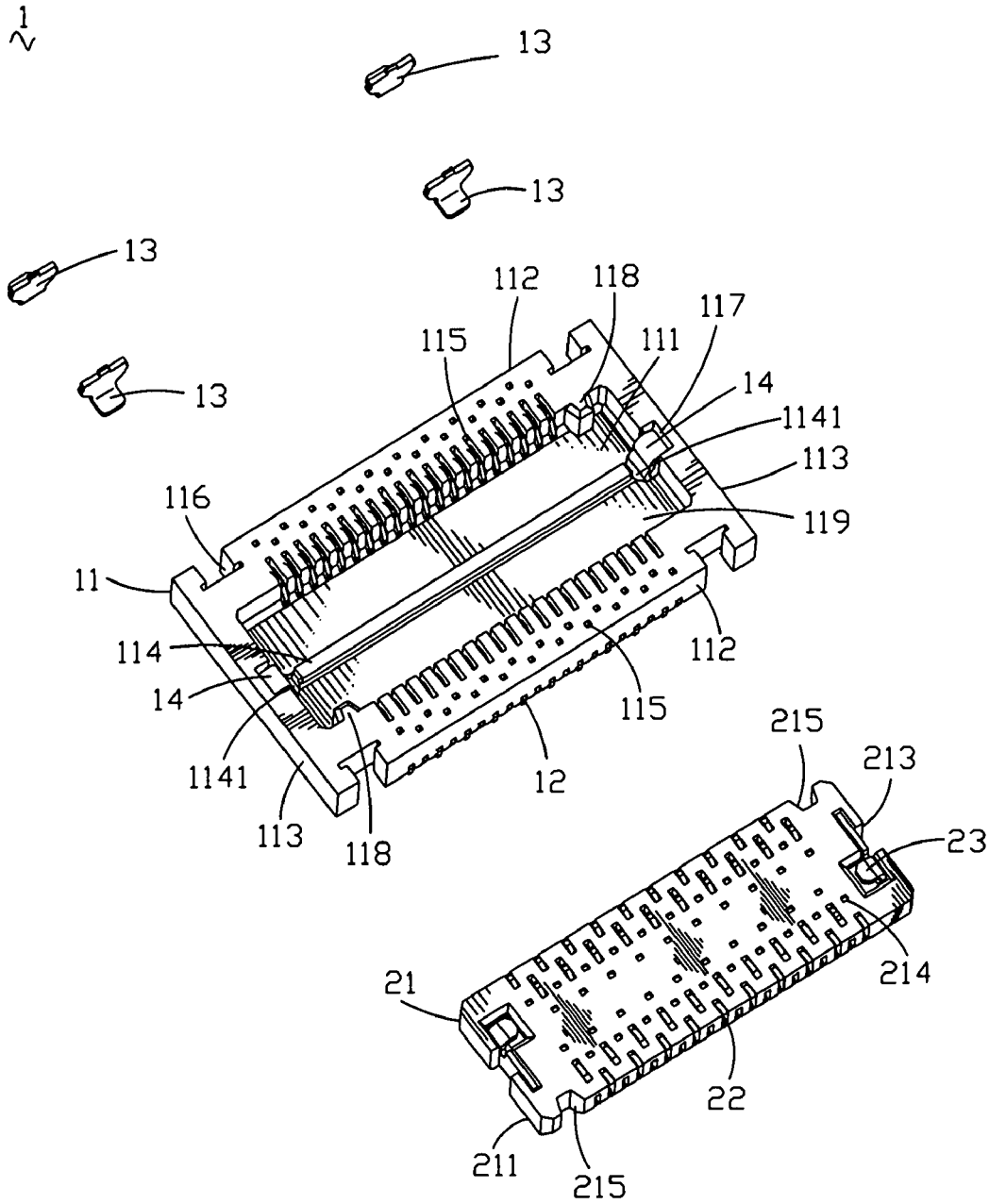
FIG. 2 is an exploded perspective view of the board-to-board connector assembly.
Figure 3:
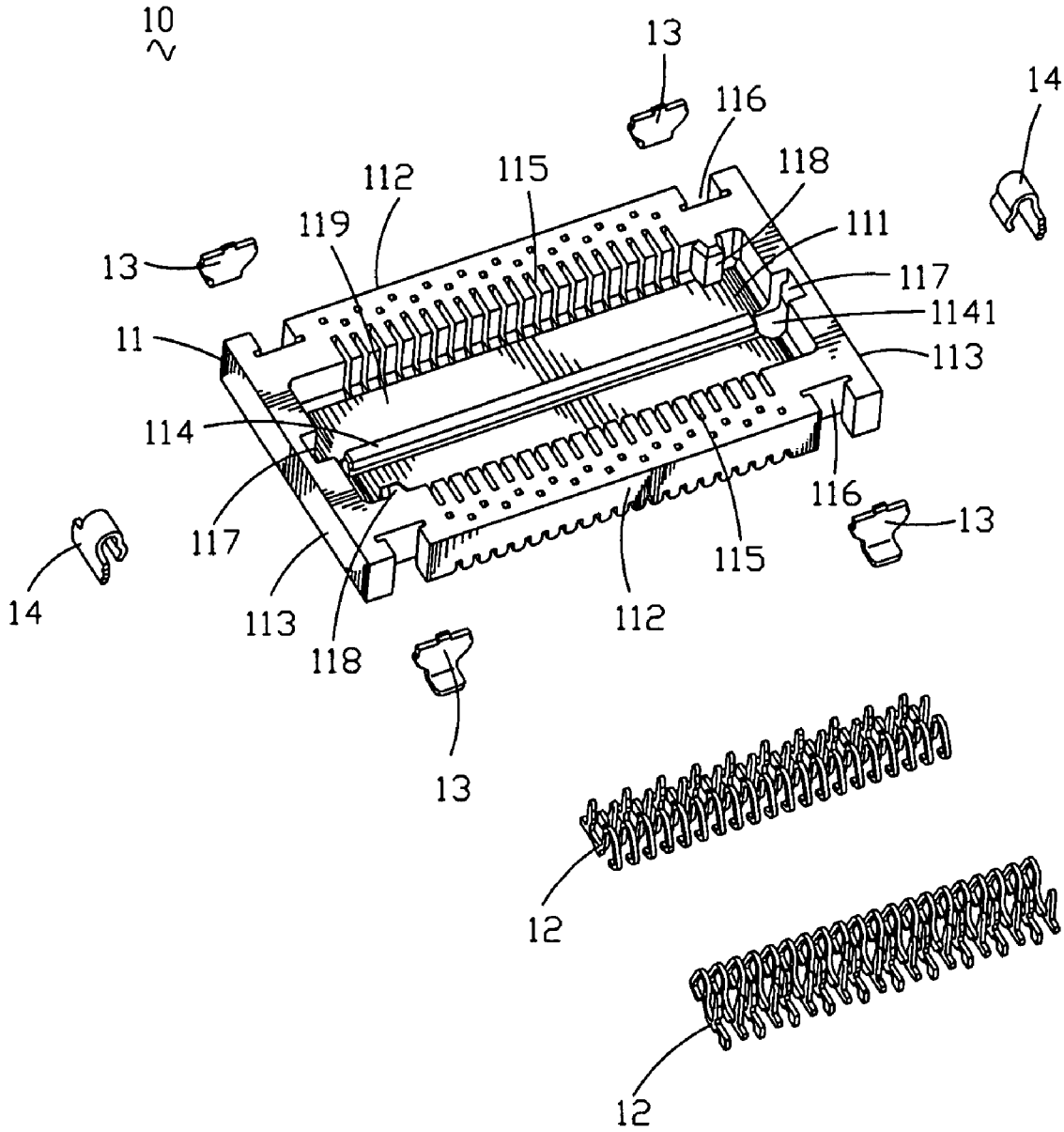
FIG. 3 is an exploded perspective view of a receptacle of the board-to-board connector assembly.
Figure 4:
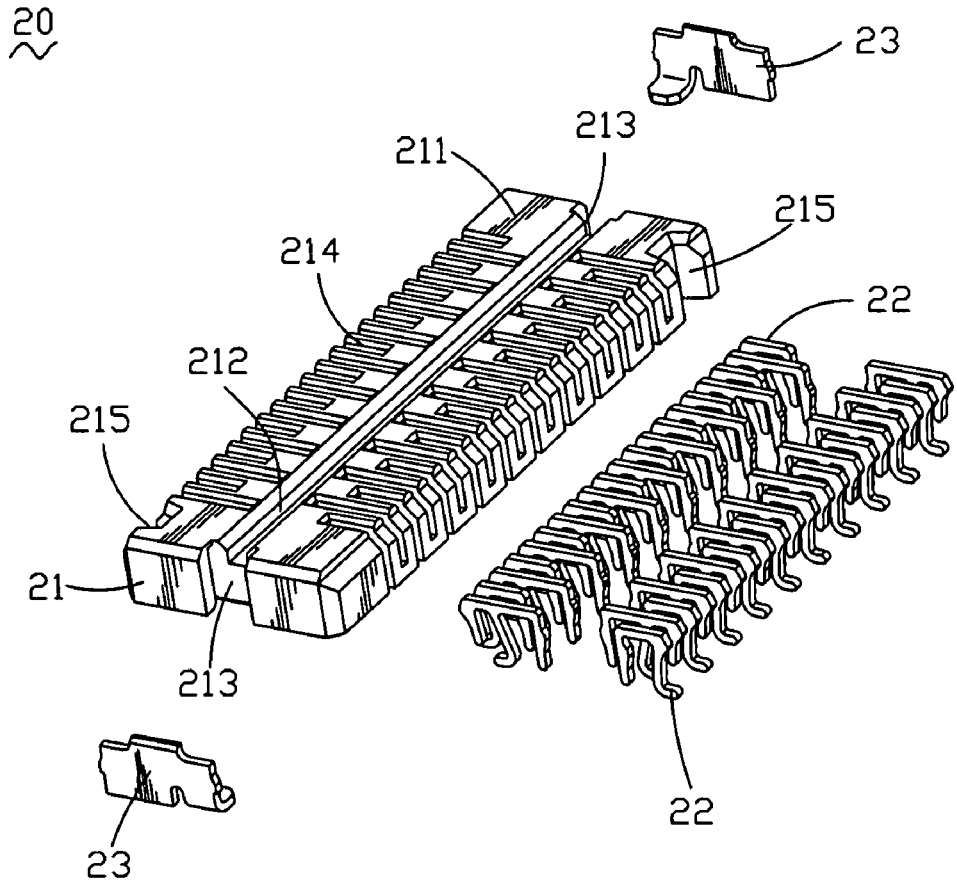
FIG. 4 is an exploded perspective view of a plug of the board-to-board connector assembly.

As shown in FIGS. 2 and 3, the receptacle 10 comprises a receptacle housing 11, a plurality of first contacts 12, four fixing members 13 and two first fixing contacts 14 received in the receptacle housing 11 respectively.

The receptacle housing 11 is of a flat rectangular configuration to have a flat base 111. Two opposite sides of the base 111 protrude upward to form a pair of first sidewalls 112 extending longwise, two opposite ends of the base 111 protrude upward to form a pair of second sidewalls 113, a recess 119 is formed among the sidewalls and the base 111. The middle of the base 111 protrudes upward into the recess 119 to form a rib 114 extending longwise. Two ends of the rib 114 are apart from the corresponding second sidewalls 113, therefore a space is formed between the rib 114 and the second sidewall 113, the space defines a notch 1141 therein. The first sidewall 112 defines a plurality of first cavities 115 arranged at regular intervals along the longwise direction of the base 111 for receiving the first contacts 12 therein. The first cavity 115 communicates with the recess 119 for allowing the first contact 12 stretching into the recess 119. One of the first sidewalls 112 protrudes inward to form a block 118 adjacent to one of the second sidewalls 113, the other first sidewall 112 protrudes inward to form a block 118 adjacent to the other second sidewall 12. Two ends of the outside of the first sidewall 112 define a fixing slot 116 respectively. The middle of the inside of the second sidewall 113 defines a first fixing groove 117. The first fixing groove 117 penetrates the top and the inner wall of the second sidewall 113 and communicates with the notch 1141.

The first fixing contact 14 has a plate-shaped first fixing portion 141, the middle of the first fixing portion 141 extends upward and then bends downward to form an elastic portion 142. A free end of the elastic portion 142 leans a little towards the first fixing portion 141, then a first convexity 144 back to the first fixing portion 141 is formed. The free end of the elastic portion 142 extends downward to form a contacting portion 143. The contacting portion 143 is bent to form a concave 145 facing the first fixing portion 141 and a second convexity 146 opposite to the concave 145, the second convexity 146 is farther apart from the first fixing portion 141 than the first convexity 144 of the elastic portion 142.

When the receptacle 10 is assembled, the first contacts 12 are received in the corresponding first cavities 115, the fixing members 13 are fixed in the corresponding fixing slots 116 for being soldered on the corresponding PCB in order to fixing the receptacle 10 on the PCB firmly. The first fixing portions 141 of the first fixing contacts 14 are received in the first fixing grooves 117 of the second sidewalls 113, the elastic portion 142 and the contacting portion 143 stretch into the recess 111, the bottom of the contacting portion 143 is received in the notch 1141 and apart from the rib 114.

The plug 20 includes a plug housing 21, a plurality of second contacts 22, and two second fixing contacts 23 received in the plug housing 21 respectively.

The plug housing 21 has a flat body 211, two sides of the body 211 define a plurality of second cavities 214 arranged at regular intervals along the longwise direction of the body 211 for receiving the second contacts 22 therein. Two sides of the plug housing 21 define a block cavity 215 corresponding to one of the blocks 118 respectively. The middle of the body 211 defines a receiving cavity 212 extending longwise corresponding to the rib 114. The middle of two ends of the plug housing 21 define a second fixing groove 213 respectively for fixing the second fixing contact 23 therein, the second fixing groove 213 penetrates the top, the bottom, the end of the plug housing 21.

Figure 5:
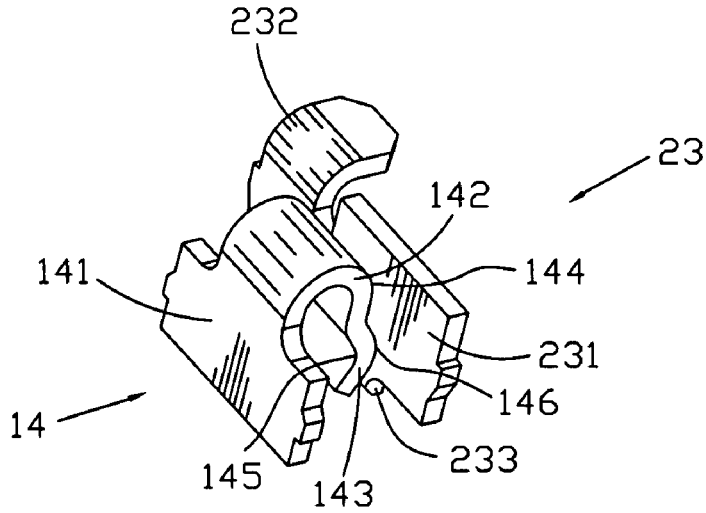
FIG. 5 is a perspective view showing a first fixing contact of the receptacle contacting against a second fixing contact of the plug.

Referring to FIG. 5, the second fixing contact 23 has a plate-shaped second fixing portion 231, one side of the second fixing portion 231 extends upward and then bends perpendicularly to form a supporting portion 232, the middle of the bottom of the second fixing portion 231 extends downward to form a flange 233. In assembly, the second fixing portion 231 is fixed in the second fixing groove 213, the supporting portion 232 is against the top of the plug housing 21 and soldered to the corresponding PCB, the flange 233 extends out of the second fixing groove 213.

Please referring to FIGS. 1, 2 and 3, when the plug 20 engages with the receptacle 10, the plug 20 is inserted into the recess 119 of the receptacle 10. The rib 114 of the receptacle 10 is inserted in the receiving cavity 212 of the plug 20. The block 118 of the receptacle 10 is locked in the corresponding block cavity 215 of the plug 20 to avoid the plug 20 is improperly inserted. The flange 233 of the second fixing contact 23 is inserted in the notch 1141. The first fixing groove 117 of the receptacle 10 communicates with the second fixing groove 213 of the plug 20. The elastic portion 142 and the contacting portion 143 stretch into the second fixing groove 213 of the plug 20, the second convexity 146 of the contacting portion 143 and the first convexity 144 of the elastic portion 142 are against the outside of the second fixing portion 231 of the second fixing contact 23, therefore, the receptacle 10 and the plug 20 can be firmly engaged with each other.

As described above, the contacting portion 143 of the first fixing contact 14 of the receptacle 10 is against the second fixing portion 231 of the second fixing contact 23 of plug 20, therefore, the receptacle 10 and the plug 20 can be firmly engaged with each other, furthermore, a reliable electrical connection between the plug 20 and the receptacle 10 is realized.

While the present invention has been described with reference to a specific embodiment thereof, the description is illustrative and is not to be construed as limiting the invention. Various modifications to the present invention may be made to the preferred embodiment by those skilled in the art without departing from the true spirit and scope of the invention as defined by the appended claims.

What is claimed is:

1. A board-to-board connector assembly, comprising:

a receptacle having a receptacle housing, having a base, two first sidewalls protruding upward from two opposite sides of the base, and two second sidewalls protruding upward from two opposite ends of the base, a recess formed among the base and the sidewalls, a plurality of arrayed first contacts mounted in the receptacle housing, and two first fixing contacts, each first fixing contact having a first fixing portion fixed in a corresponding second sidewall, the middle of the first fixing portion extending upward then bending downward to form an elastic portion, the elastic portion extending to form a contacting portion extending into the recess of the receptacle housing; and a plug having a plug housing, received in the recess of the receptacle housing, a plurality of arrayed second contacts mounted in the plug housing for electrically connecting the corresponding first contacts of the receptacle, and two second fixing contacts, each second fixing contact having a second fixing portion fixed in two opposite ends of the plug housing, the contacting portion of the first fixing contact being against the outside of the second fixing portion;

a middle of an inside of the second sidewall defines a first fixing groove for fixing the first fixing portion of the first fixing contact, the first fixing groove penetrates an inner wall of the second sidewall, a middle of two ends of the plug housing define a second fixing groove respectively for fixing the second fixing contact therein, each second fixing groove penetrates a respective end of the plug housing to communicate with the first fixing groove of the receptacle housing;

a middle of the base protrudes upward into the recess to form a rib extending longwise, two ends of the rib are apart from the corresponding second sidewalls, a space is formed between the rib and the second sidewall where the first fixing contact is against the second fixing contact.

2. The board-to-board connector assembly as claimed in claim 1, wherein the space defines a notch communicating with the first fixing groove therein, the bottom of the contacting portion is received in the notch and apart from the rib, the middle of the bottom of the second fixing portion extends downward to form a flange, the flange extends out of the second fixing groove and is inserted in the notch.

3. The board-to-board connector assembly as claimed in claim 1, wherein the second fixing portion extends upward and then bends perpendicularly to form a supporting portion, one end of the supporting portion abuts a top of the plug housing and another end is soldered to a corresponding PCB.

4. The board-to-board connector assembly as claimed in claim 1, wherein the elastic portion has a free end which leans a little towards the first fixing portion, then a first convexity back to the first fixing portion is formed, the free end of the elastic portion extends downward to form the contacting portion, the contacting portion is bent to form a concave facing the first fixing portion and a second convexity opposite to the concave, the second convexity is farther apart from the first fixing portion than the first convexity of the elastic portion, the first convexity and the second convexity are against the outside of the second fixing portion.

* * * * *